United States Patent [19]

Voss et al.

[11] Patent Number: 4,699,304

[45] **Date of Patent: * Oct. 13, 1987**

[54] METERED LEVER OPERATING MECHANISM FOR PAPER TOWEL DISPENSER CABINET

[75] Inventors: Thomas C. Voss, Green Bay; Delos P. Lesperance, DePere; Myron F. Lindeman, Green Bay, all of Wis.

[73] Assignee: Mosinee Paper Corporation, Mosinee, Wis.

[ * ] Notice: The portion of the term of this patent subsequent to May 12, 2004 has been disclaimed.

[21] Appl. No.: 750,848

[22] Filed: Jul. 1, 1985

[51] Int. Cl.[4] ..... B65H 20/02; B65H 23/18

[52] U.S. Cl. ..... 226/129; 242/55.2; 312/37

[58] Field of Search ..... 226/127, 129, 130, 133, 226/161; 242/55.2, 55.53, 58; 312/37, 38, 215

[56] References Cited

U.S. PATENT DOCUMENTS

| | | | |
|---|---|---|---|
| 966,795 | 8/1910 | Canfield . | |
| 2,002,568 | 5/1935 | Darman | 312/38 X |
| 2,946,587 | 7/1960 | Ryno | 226/130 |
| 3,010,338 | 11/1961 | Layton | 226/129 X |
| 3,045,885 | 7/1962 | Dahlin et al. | 226/130 |
| 3,288,387 | 11/1966 | Craven, Jr. | 242/55.3 |
| 4,165,138 | 8/1979 | Hedge et al. | 242/55.53 X |
| 4,406,421 | 9/1983 | Schultz et al. | 226/129 X |

*Primary Examiner*—Stuart S. Levy
*Assistant Examiner*—Lynn M. Sohacki
*Attorney, Agent, or Firm*—Quarles & Brady

[57] ABSTRACT

A metered lever operating mechanism for a paper towel dispenser cabinet is disclosed. The operating mechanism has a lever actuator which is mounted in the dispenser cabinet for vertical reciprocating movement. The lever actuator has a handle which is operable by a user and a rack having gear teeth which mesh with a drive train. The drive train converts the downward stroke of the lever actuator into rotary motion to rotate a drive pinion. The drive pinion is connected to drive a delivery mechanism to deliver paper towel to the exterior of the dispenser cabinet. A metering assembly engages the drive pinion to limit the number of successive reciprocations of the lever actuator. The metering assembly must be reset between each series of successive reciprocations of the lever actuator to deter wasteful use of paper towel.

7 Claims, 20 Drawing Figures

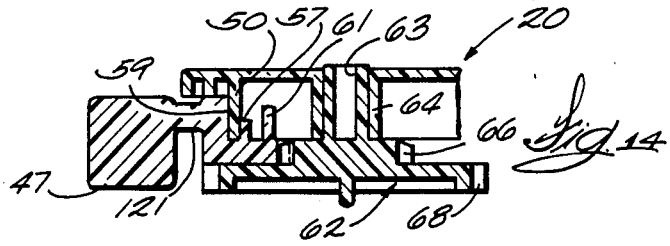
Fig. 14
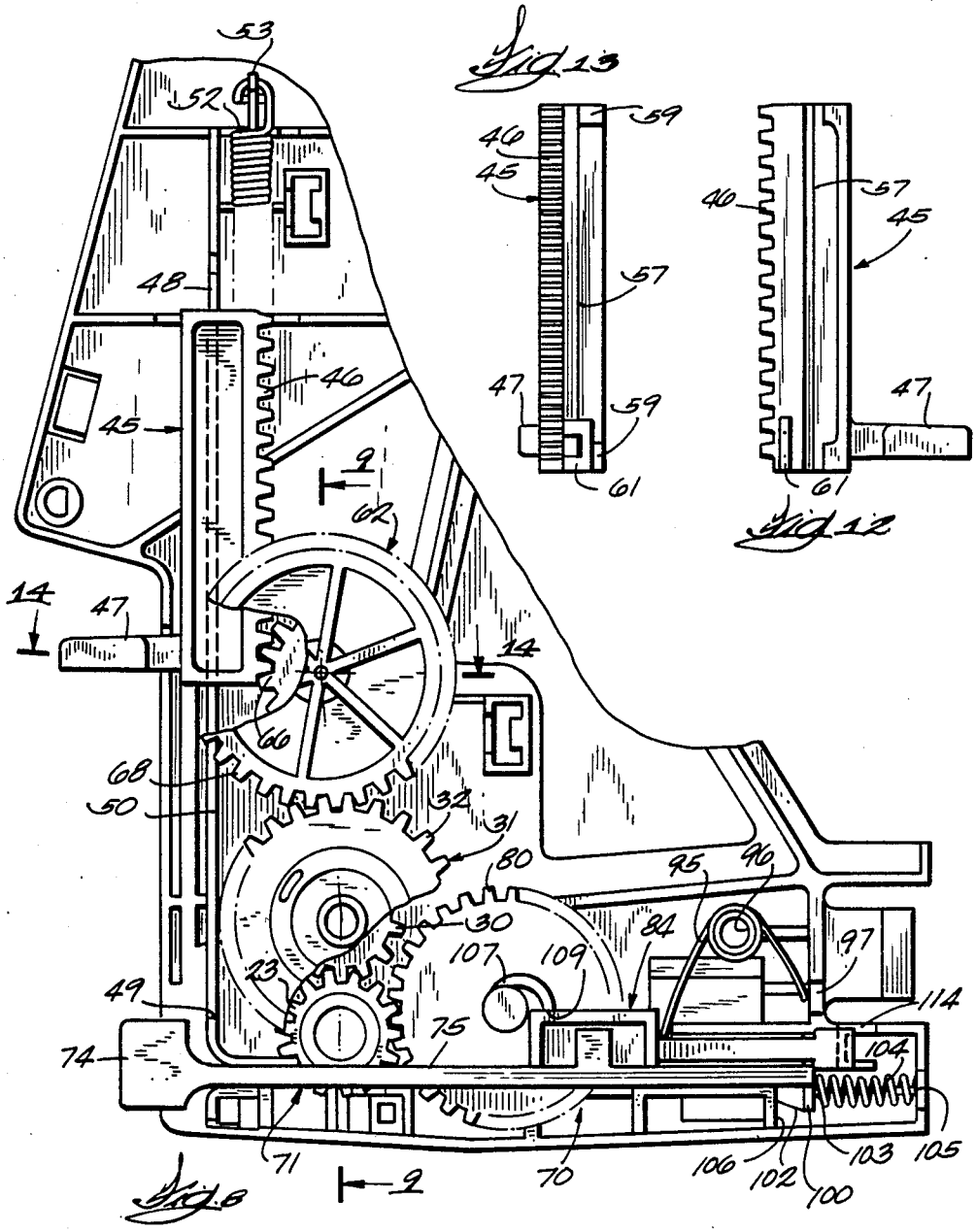
Fig. 6
Fig. 13
Fig. 12

METERED LEVER OPERATING MECHANISM FOR PAPER TOWEL DISPENSER CABINET

TECHNICAL FIELD

This invention relates to the art of paper towel dispenser cabinets and in particular to operating mechanisms employed in paper towel dispenser cabinets.

BACKGROUND OF THE INVENTION

Paper towel dispenser cabinets are well known. They can be found in many public lavatories where they hang on walls to dispense paper towel for users to dry their hands.

Prior art dispenser cabinets usually have either a crank or a lever which the user operates to dispense towel. With these dispensers, a user simply turns a crank or operates a lever until the desired length of towel is dispensed.

The prior art has recognized that allowing a user unbridled discretion as to the amount of paper towel dispensed can result in waste. To help eliminate such waste and conserve paper, some prior art dispensers of the crank mode of operation are provided with a metering feature which provides an impediment to continuous dispensing. The metering feature usually requires the user to press a button or reverse rotation of the crank every couple of rotations of the crank to continue dispensing. Since a couple of rotations of the crank dispenses a length of towel which is sufficient in most circumstances, a user is inclined to settle for that length rather than expend the additional work necessary to continue dispensing.

However, the prior art does not include paper towel dispensers of the lever mode of operation in which a metering feature is provided. As attested by the fact that unmetered crank and lever mode paper towel dispenser cabinets coexist, the lever mode of operation is desirable in some circumstances. Therefore, a need exists for a paper towel dispenser cabinet having a metered lever mode operation.

SUMMARY OF THE INVENTION

The invention provides a paper towel dispenser cabinet which is operable by a metered lever mode of operation. A lever actuator which is operable by a user is mounted in the dispenser for reciprocating movement in a vertical plane. An operating mechanism converts the vertical motion of the lever actuator into rotary motion to drive a delivery mechanism in engagement with the paper towel. A metering assembly which is operable by a user to release the lever actuator is in engagement with the operating mechanism to limit the number of successive reciprocations of the lever actuator between operations of the metering assembly by the user. The metering assembly must be reset between each series of successive reciprocations of the lever actuator. Thereby, excessive dispensing and waste of paper towel is deterred in a lever operated paper towel dispenser.

DESCRIPTION OF THE DRAWINGS

The present invention is described below, as required by 35 U.S.C. §112, in such full detail as to enable those skilled in the art to practice the invention and also to set forth the presently-contemplated best modes for its practice, all by reference to the following drawings in which:

FIG. 1 is a perspective view of a paper towel dispenser cabinet which incorporates an operating mechanism constructed in accordance with this invention;

FIG. 8 is a fragmentary view with portions broken away of the mechanism module of FIG. 5 shown without the cover to show the operating mechanism;

FIG. 12 is a side view of a lever actuator for the mechanism module of FIG. 8 as viewed from the side opposite from the side shown in FIG. 8;

FIG. 13 is a rear side view of the lever actuator of FIG. 12;

FIG. 14 is a sectional view taken along the plane of line 14—14 of FIG. 8;

DETAILED DESCRIPTION OF THE PREFERRED EMBODIMENT

Figure 2:
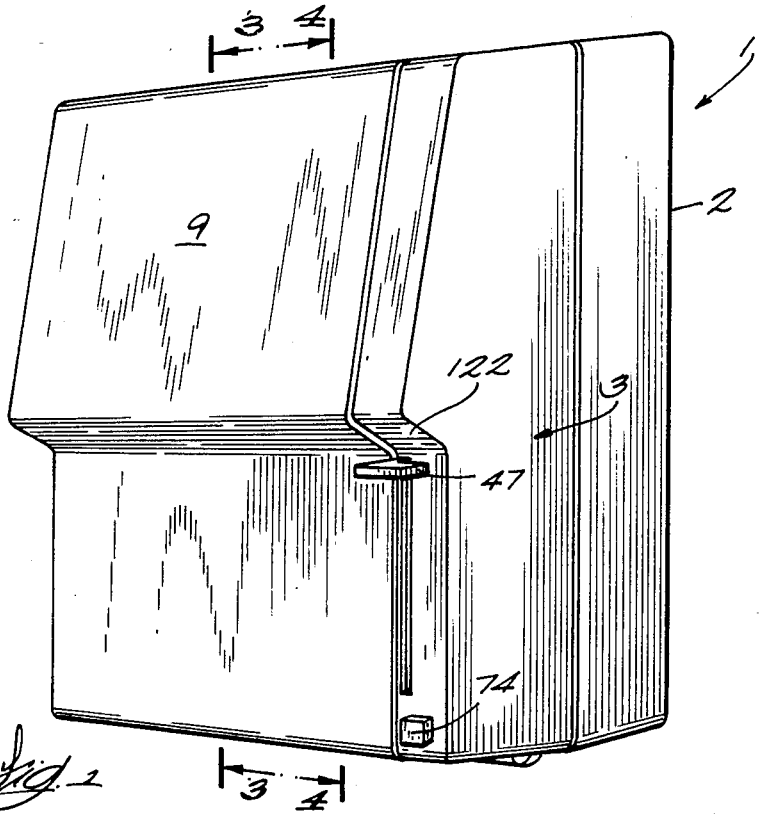
FIG. 2 is a perspective view of the dispenser of FIG. 1 shown with the door open.

FIGS. 1–4 show a complete assembled dispenser cabinet 1 which includes an operating mechanism of the present invention. The dispenser cabinet 1 includes a back 2, a mechanism module 3, a delivery mechanism including a drive roll 4, an idler roll 5 and a transfer bar 6, a feed roll support arm 7, a reserve roll support arm 8 and a lockable door 9. The mechanism module 3 houses the operating mechanism and is attached to the back 2 to form the right front side of the dispenser and carries the right hand end of the delivery mechanism. The left hand end of the delivery mechanism is supported by the feed roll support arm 7 which is mounted to the back opposite from the mechanism module 3. The reserve roll support arm 8 is assembled to the back 2 above the feed roll support arm 7 and the door 9 is hingedly connected to the back to complete the dispenser cabinet 1. While an operating mechanism of the present invention can be incorporated in many different types of dispenser cabinets, a full description of the cabinet 1 is given in the U.S. patent application entitled Modular Paper Towel Dispenser, Ser. No. 751,336 now U.S. Pat. No. 4,611,768, which was filed on even date herewith and is hereby incorporated by reference.

Figure 3:
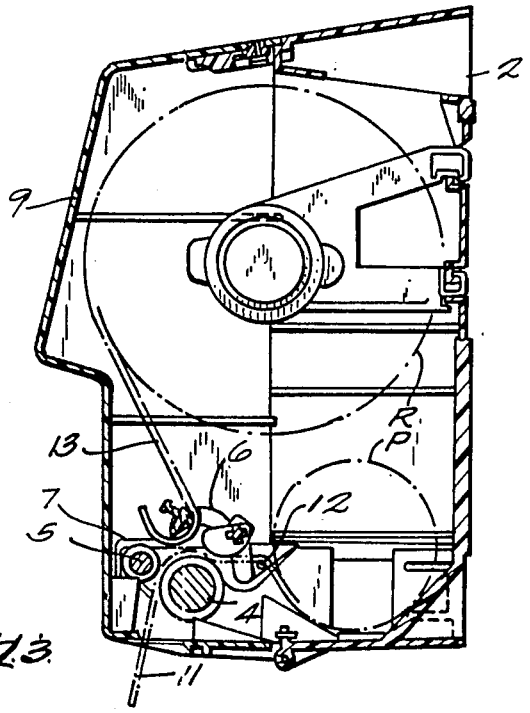
FIG. 3 is a sectional view taken along the plane of line 3—3 of FIG. 1.
Figure 2:
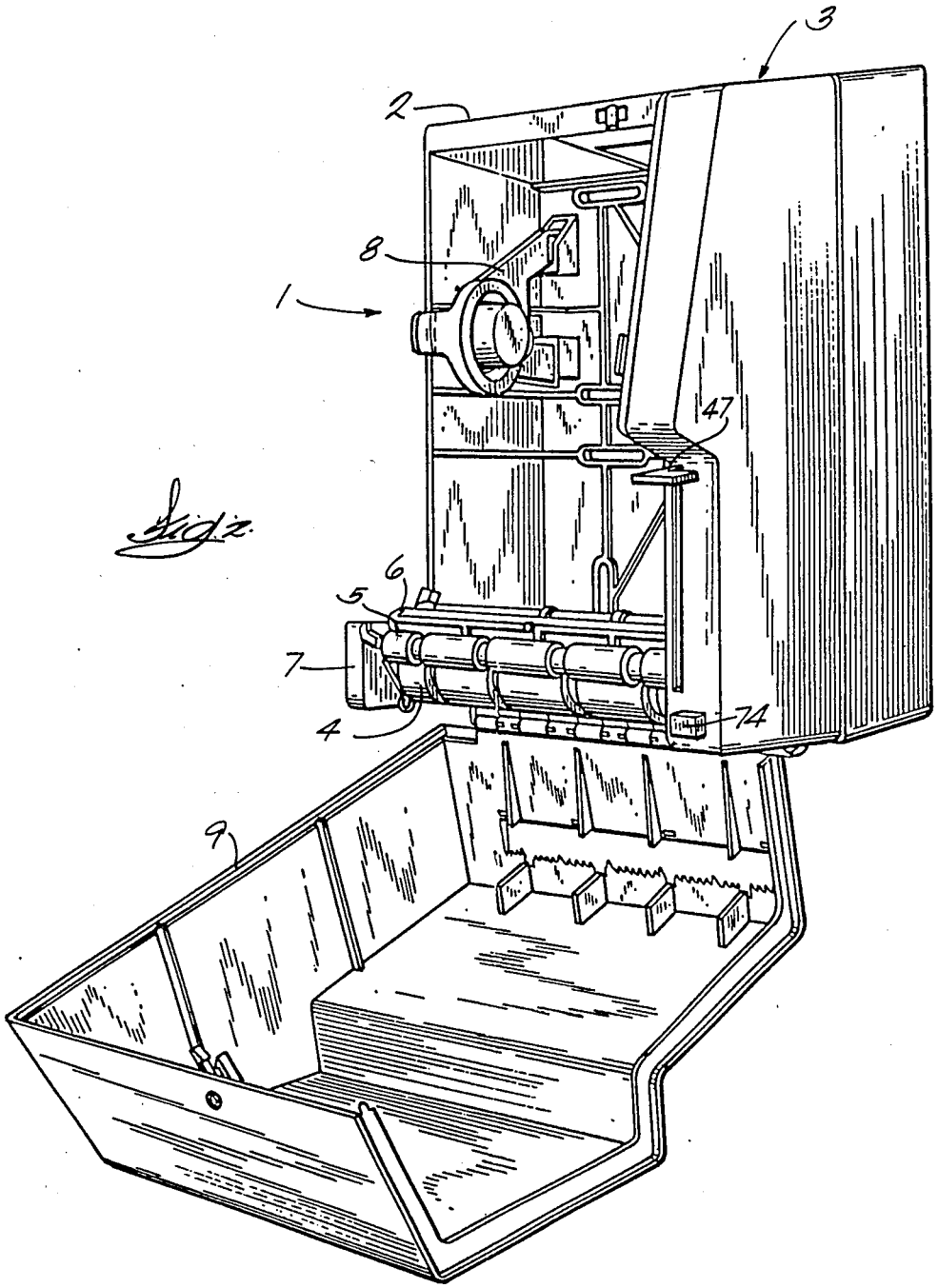

In service, the back 2 is secured to a wall (not shown). Referring to FIG. 3, a web 11 of paper towel from a primary roll P supported in the bottom of the back is first threaded up over a rod 12 which is non-rotatably mounted between the mechanism module 3 and the feed roll support arm 7. The web 11 is then threaded between the drive roll 4 and the transfer bar 6, and into the nip between the drive and idler rolls 4 and 5, respectively, to be frictionally engaged by the drive roll 4. A web 13 of paper towel from a reserve roll R which is supported at one end by the reserve roll support arm 8 and at its other end by the mechanism module 3 is threaded through the transfer bar 6 and up over the idler roll 5. When a user operates the operating mechanism of the mechanism module 3, the drive roll 4 is rotationally driven to dispense a length of the web 11 from the primary roll P. When the primary roll P is exhausted and the end of its web passes by the transfer bar 6, the transfer bar urges the reserve roll web 13 into the nip between the drive and idler rolls to be dispensed. The details of operation of the delivery mechanism are not essential to an operating mechanism of the present invention but are more particularly described in Hedge et al. U.S. Pat. No. 4,165,138, issued Aug. 21, 1979, the disclosure of which is hereby incorporated by reference.

Figure 6:
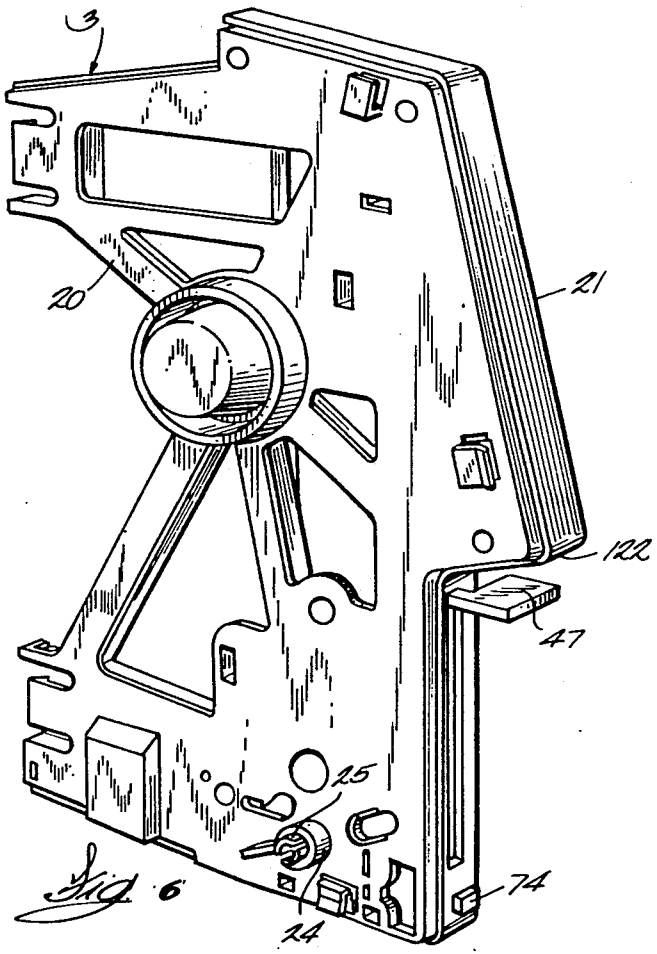
FIG. 6 is a perspective view of the mechanism module of FIG. 5 as viewed from the left front side.
Figure 5:
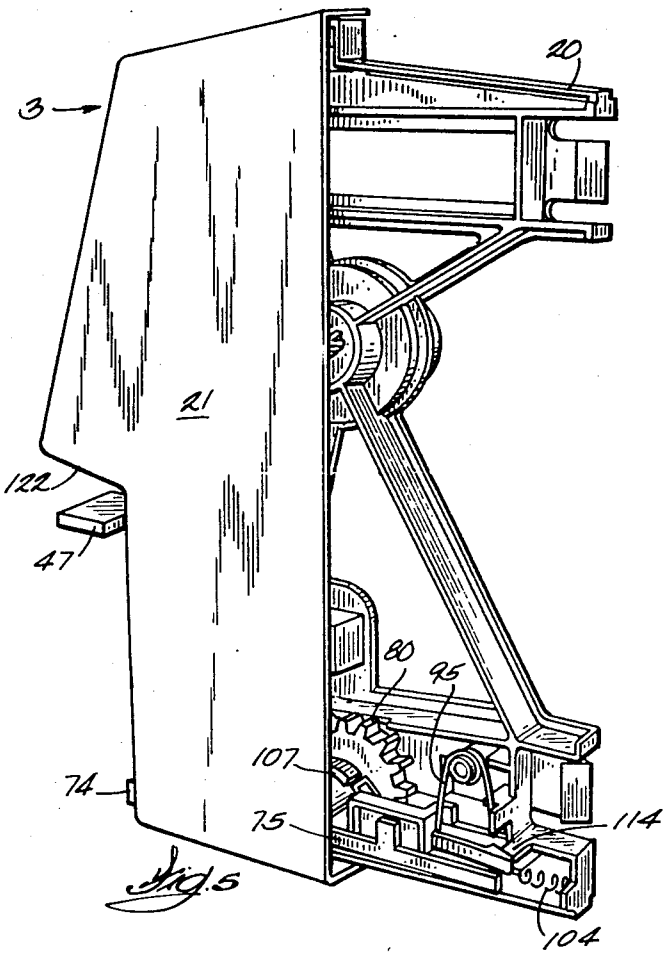
FIG. 5 is a perspective view of a mechanism module for the dispenser of FIG. 1 as viewed from the right rear side.

The mechanism module 3 houses the operating mechanism and is shown by itself in FIGS. 5 and 6. It comprises a mechanism plate 20 to which all of the components of the operating mechanism are mounted. It also includes a cover 21 which is mounted to the mechanism plate to hold the operating mechanism in place and which is part of the exterior of the dispenser cabinet. The mechanism plate, the cover and all of the components of the operating mechanism except a few springs are preferably molded from suitable plastic materials.

Figure 7:
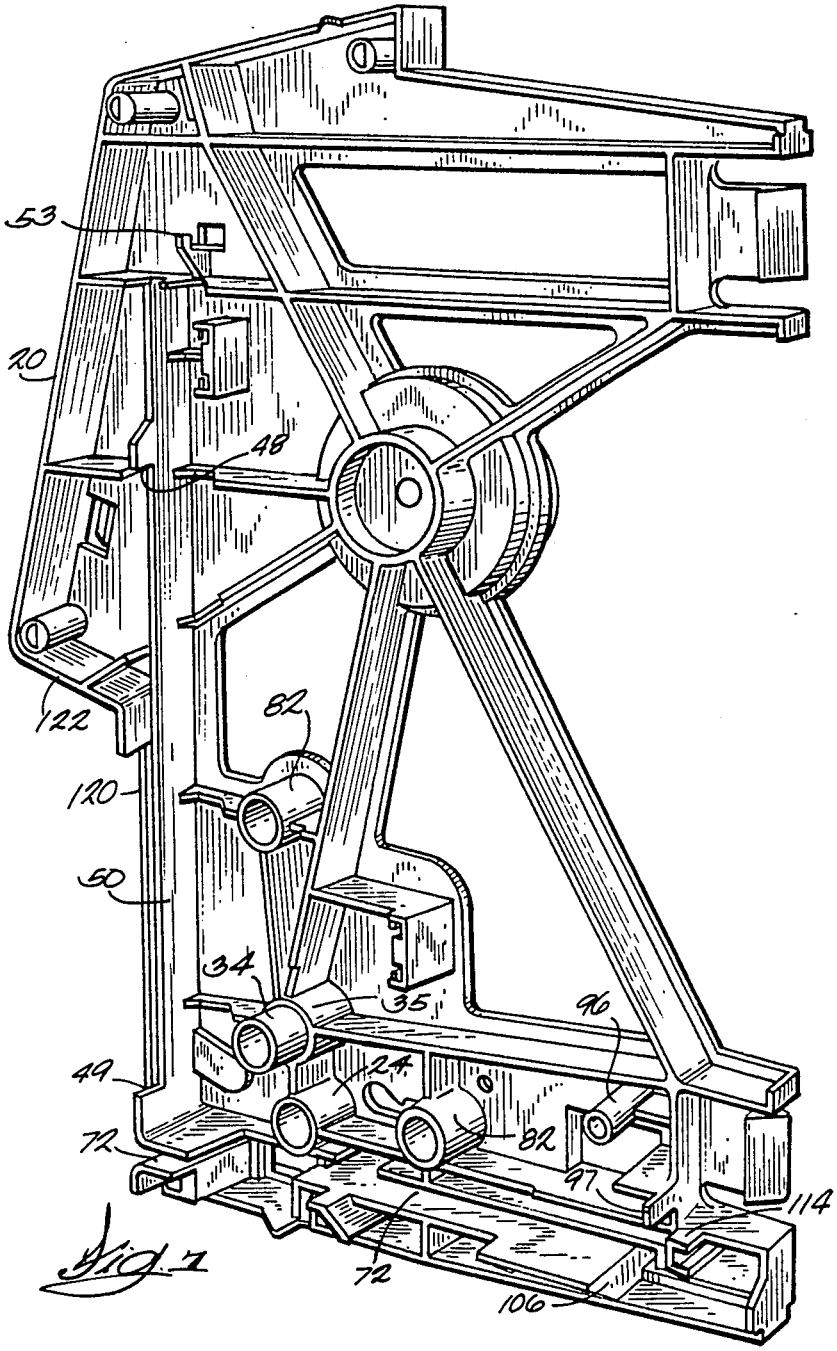
FIG. 7 is a perspective view of the mechanism plate for the mechanism module of FIG. 5 as viewed from the right rear side.
Figure 9:
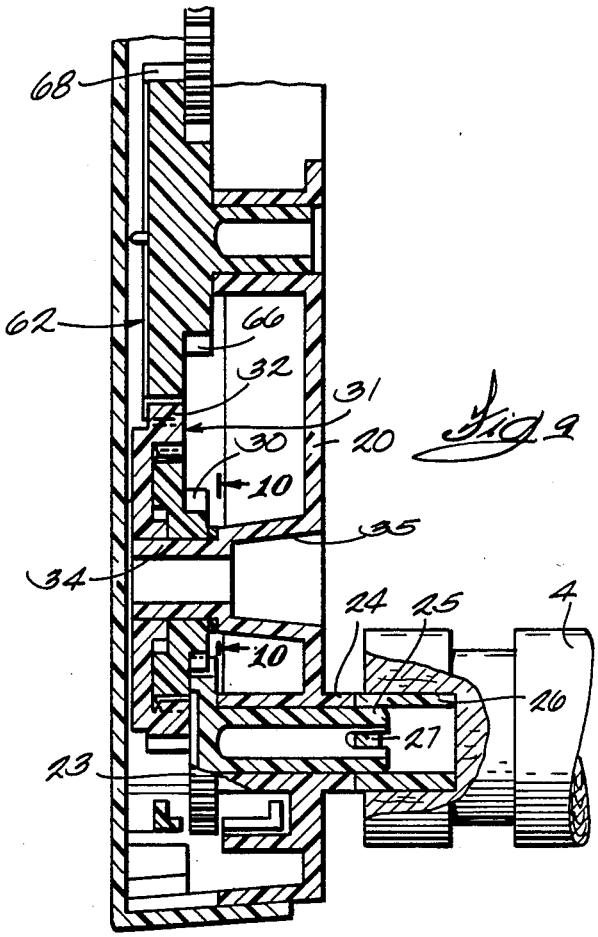
FIG. 9 is a sectional view taken along the line 9—9 of FIG. 8 and showing the connection between the drive pinion and the feed roll.

The operating mechanism rotatably drives the drive roll 4 to dispense the paper towel. Referring to FIGS. 7–9, a drive pinion 23 having an integral shaft is journaled in a sleeve 24 which is integral with the mechanism plate 20 and is strengthened by reinforcing ribs. The sleeve 24 extends a short distance from the drive roll side of the mechanism plate 20 and the end 25 of the drive pinion shaft extends beyond the end of the sleeve (FIGS. 6 and 9). The end 25 of the drive pinion shaft is forked to rotationally engage the end of the feed roll 4 in which a sleeve 26 is mounted which has an integral diametral web 27. The web 27 fits between the forks of the drive pinion shaft to provide a driving connection between the drive pinion 23 and the feed roll 4.

Referring to FIGS. 8 and 9, the drive pinion 23 meshes with a clutch gear 30 of an overrunning clutch 31 which also includes a drive gear 32. The overrunning clutch 31 is rotationally mounted on a stub sleeve 34 projecting from a larger diameter sleeve 35 which is integral with the mechanism plate 20 and which is strengthened by reinforcing ribs. The overrunning clutch 31 insures that the drive pinion 23 will be driven in only one direction so that the drive roll cannot be rotated backwardly by the operating mechanism.

Figure 10:
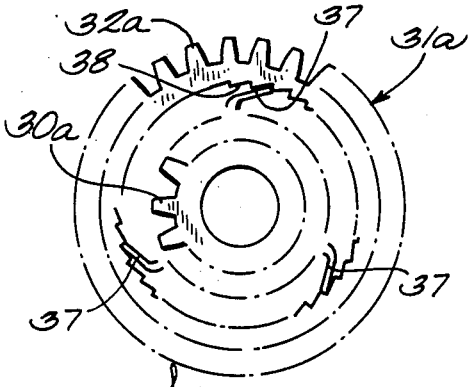
FIG. 10 is a detail view of an overrunning clutch for the mechanism module of FIG. 9 as viewed from the plane of line 10—10 of FIG. 9.

The overrunning clutch 31 may take any of a number of forms. One such form is the clutch **31*a* shown in FIG. 10. In clutch 31*a*, the clutch gear 30*a* has a number of pawls 37 on a rearward hub which engage an inner ratchet surface 38 of the drive gear 32*a* when the drive gear 32*a* is rotated clockwise as viewed in FIG. 8. If the drive gear 32*a* is rotated counter-clockwise relative to the clutch gear 30*a* as viewed in FIG. 8, the friction of the delivery mechanism is sufficient to hold the clutch gear 30*a* still so that the pawls 37 overrun the ratchet surface 38** and make a noise which puts the user on notice that he is cranking in the wrong direction.

Figure 11:
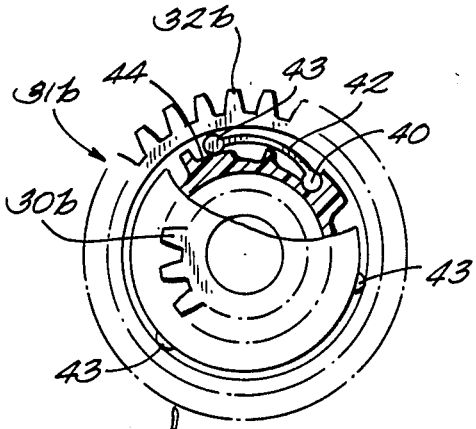
FIG. 11 is a detail view of a second embodiment of an overrunning clutch for the mechanism module of FIG. 9 as viewed from the plane of line 10—10 of FIG. 9.

Alternatively, if silent overrunning operation is desirable, the clutch **31*b* of FIG. 11 could be used. In this arrangement, the clutch gear 30*b* has a rearward hub within the drive gear 32*b* which captivates a cylindrical end 40 of each of three flexible clutch dogs 42, one of which is shown in full. The other cylindrical end 43 of each of the clutch dogs 42 is frictionally engaged between an inner surface of the drive gear 32*b* and a raised surface 44 on the hub of the clutch gear 30*b*. When the drive gear 32*b* is rotated clockwise as viewed in FIG. 8, the wedging action of the clutch dogs 42 locks the clutch gear 30*b* to the drive gear 32*b* so that the two gears rotate together. When the drive gear 32*b* is rotated counterclockwise as viewed in FIG. 8, the friction in the delivery mechanism holds the clutch gear 30*b* stationary as the drive gear 32*b*** rotates freely relative to the clutch gear.

A lever actuator 45 which is reciprocable in a vertical plane is provided to drive the drive gear 32. The lever actuator 45 has an integral rack 46 having gear teeth and a handle 47 which is operable by a user. The lever actuator 45 is slidably mounted for vertical translatory motion between an upper stop 48 and a lower stop 49 of a slide bar 50 which is molded into the mechanism plate 20 and is best shown in FIG. 7. An extension spring 52 is connected between the lever actuator 45 and a finger 53 of the mechanism plate 20 to bias the lever actuator upwardly.

FIGS. 13 and 14 show the lever actuator 45 apart from the mechanism module 20. A runner 57 which extends over the length of the lever actuator and a pair of rearwardly facing steps 59 on the ends of the lever actuator define a space between them to receive the slide bar 50 as shown in FIG. 14. As shown in FIG. 13, a U-shaped connector 61 is formed at the lower end of the rack 46. The lower end of the extension spring 52 is attached to the connector 61 to bias the lever actuator upwardly.

A rack gear 62 couples the lever actuator 45 to the overrunning clutch 31. Referring to FIGS. 8, 9 and 14, the rack gear 62 has an integral shaft 63 which is journaled in a rib reinforced sleeve 64 of the mechanism plate 20. The shaft 63 terminates in an integral rack pinion 66 which meshes with the rack 46 of the lever actuator 45. The rack pinion 66 is integral with a rack drive gear 68 which meshes with the drive gear 32 of the overrunning clutch 31.

In operation, as the lever actuator 45 is moved downwardly, it drives the rack gear 62 counterclockwise as viewed in FIG. 8. The rack gear 62 drives the drive gear 32 of the overrunning clutch 31 clockwise so that it is fixedly coupled to the clutch gear 30 which therefore also rotates clockwise. This rotates the drive pinion 23 counterclockwise to drive the drive roll 4 to dispense a length of paper towel. On the upward, return stroke of the rack 46, the rack gear 62 is rotated clockwise and the drive gear 32 is rotated counterclockwise. When driven in this direction, the drive gear 32 overruns the clutch gear 30, which remains stationary due to friction in the drive system. The lever actuator 45 thereby returns to the top of its stroke without driving the drive roll 4 backwardly.

The operating mechanism thus far described is made metered by incorporating the additional mechanism comprising the metering assembly 70 shown in FIGS. 8 and 15–17. The metering assembly 70 requires the user to press a button before operating the rack 46 to dispense a length of sheet material. Even then, only a limited number of successive reciprocations of the lever actuator 45 is allowed before the button must be reset to continue dispensing. One pressing of the button allows a number of reciprocations of the lever actuator 45 which dispenses a length of sheet material adequate for the normal person to dry his or her hands. Any more dispensed paper towel usually would only result in waste. The metered feature therefore introduces an impediment against excessive dispensing to deter waste of paper towel.

Figure 15:
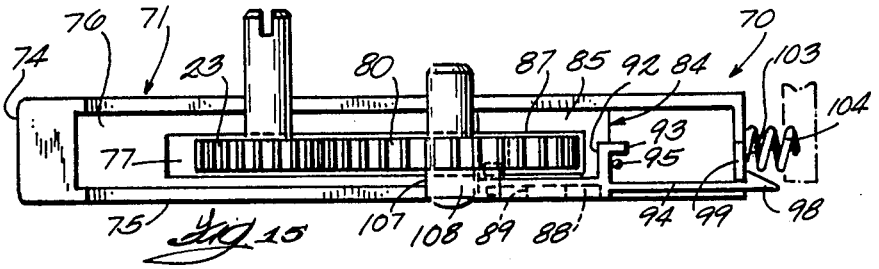
FIG. 15 is a top view of the metering assembly portion of the operating mechanism of FIG. 8 shown together with the drive pinion in the stopped position.
Figure 16:
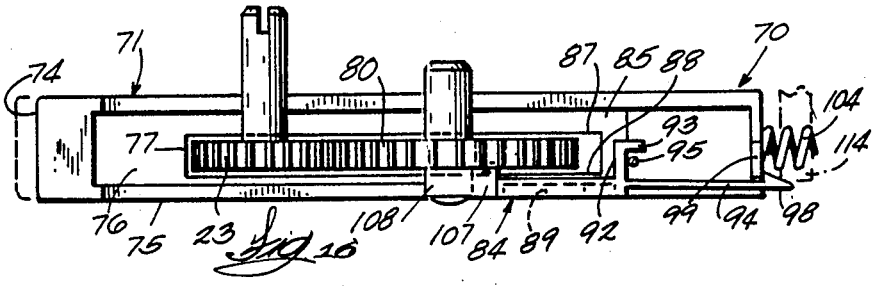
FIG. 16 is a view similar to FIG. 15 but with the metering release of the metering assembly shown in a depressed position.
Figure 17:
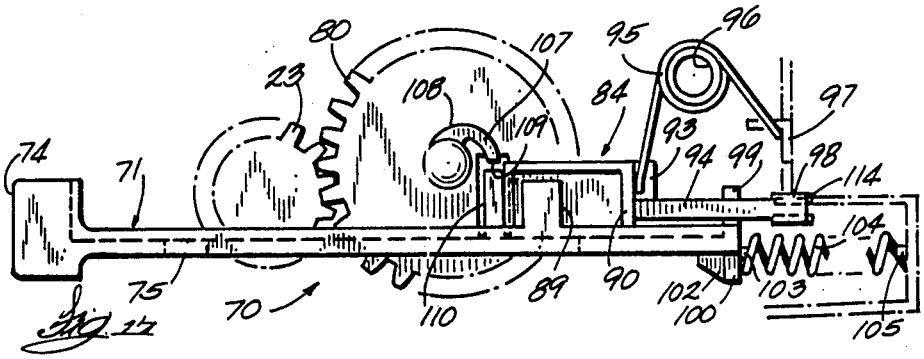
FIG. 17 is a side view of the metering assembly of FIGS. 15 and 16 shown in a dispensing position.

For clarity, FIGS. 15–17 show only the drive pinion 23 together with the components of the metering assembly 70. The metering assembly 70 has a metering release 71 which is slidably disposed in a channel 72 (FIG. 7) of the mechanism plate 20. It includes a button 74 at the front and a rectangular body 75 which extends rearwardly from the button. As best shown in FIGS. 15 and 16, the interior 76 of the body is recessed and includes a slot 77 in which the lower portions of the drive pinion 23 and a metering gear 80 are disposed. The drive pinion 23 is journaled in the mechanism plate as previously described and the metering gear is journaled in a rib reinforced sleeve 82 (FIGS. 7 and 19) of the mechanism plate 20. The slot 77 is wide enough to allow the drive pinion 23 and the metering gear 80 to rotate freely and long enough to avoid interference with the gears in all positions of operation.

A release stop 84 is slidably received in the interior 76 of the body 75 near the rear of the slot 77. The release stop 84 has a base 85 which extends across the width of the recessed interior 76 and has a forwardly opening slot 87 which is aligned with the slot 77 and in which the metering gear 80 is disposed and can rotate freely. A stop wall 88 extends upwardly along the outside edge of the base 85 adjacent to the side surface of the metering gear 80 and is restrained against outward movement by a support tab 89 which extends upwardly from the edge of the metering release 71 and abuts the stop wall 88. The sides of a raised rim 90 on the stop wall 88 provide outer limits for the sliding motion of the release stop 84 relative to the metering release 71.

The rear portion of the stop wall 88 and the raised rim 90 are integral with a rear wall 92 which projects upwardly from the rear of the base 85. A tab 93 and a cantilever spring catch 94 project rearwardly from the rear wall 92 to define a space between them on the rear wall in which one end of a torsion spring 95 which is mounted on a sleeve 96 (FIGS. 7, 8 and 17) of the mechanism plate 20 is disposed. The other end of the torsion spring 95 presses against a wall 97 of the mechanism plate so that the spring 95 urges the release stop 84 toward the axis of the metering gear 80. The spring catch 94 has a ramped end 98 which, as shown in FIGS. 15 and 16, defines a forwardly facing shoulder which is normally caught behind an upstanding tab 99 which extends upwardly from the rear edge of the metering release 71.

A rear wall 100 extends downwardly from the rear edge of the metering release 71, is reinforced by a fillet 102, and has a stub 103 on its rear surface. The stub 103 captivates one end of a compression spring 104 which has its other end captivated by a stub 105 (FIGS. 8 and 17) on the mechanism plate 20. The forward edge of the rear wall reinforcing fillet 102 abuts an edge 106 of the mechanism plate 20 to limit the forward movement of the metering release 71.

Figure 18:
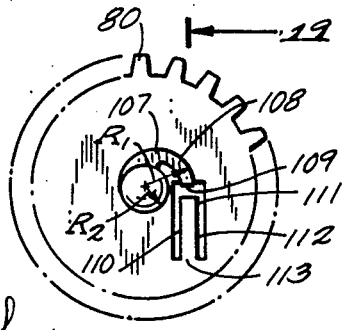
FIG. 18 is a side plan view of a metering gear for the metering assembly of FIGS. 15–17.
Figure 19:
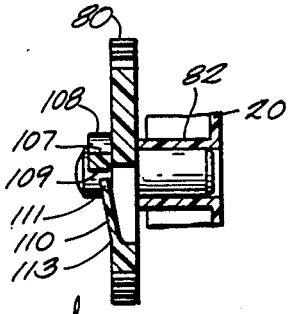
FIG. 19 is a sectional view of the metering gear of FIG. 18 taken along the plane of line 19—19 of FIG. 18 and showing the mounting sleeve of the metering gear in section.

Referring to FIGS. 18 and 19, the metering gear 80 has a cam portion 107 which is integral with and extends axially from the side surface of the metering gear. The radially outward surface of the cam portion defines a cam surface 108 which extends continuously around the axis of the metering gear from a larger radius $R_1$ to a smaller radius $R_2$ in the counterclockwise direction. A discontinuity in the radius of the cam surface at the angular position where both the larger radius and the smaller radius are disposed defines an abutment wall 109 adjacent to the larger radius end of the cam surface.

The side surface of the metering gear 80 also has an integral resilient finger 110. A free end 111 of the resilient finger 110 is disposed adjacent to the abutment wall 109 of the cam portion. The resilient finger 110 is biased outward from the plane of the side of the metering gear and the outer edge 112 of the resilient finger 110 is substantially aligned with the larger radius end of the cam surface 108 adjacent to the abutment wall 109. The resilient finger 110 extends from a connected end 113 in the plane of the metering gear 80 to the free end 111 in the counterclockwise direction and is resilient in a plane perpendicular to the plane of the metering gear so that it can be pressed into the plane of the side of the metering gear.

To dispense a length of sheet material, a user must first depress or reset the button 74 to move the metering release 71 and the release stop 84 backwardly against the forward biasing forces of the springs 95 and 104. When the button 74 is depressed about as far as shown in FIG. 16, the stop wall 88 of the release stop 84 is moved past the resilient finger 110 so that the resilient finger 110 snaps outwardly. When the button 74 is pushed a little further rearwardly than shown in FIG. 16, the forwardly facing shoulder of the ramped end 98 of the spring catch 94 is released from being caught behind the upstanding tab 99 by a projection 114 of the mechanism plate 20 and the release stop 84 is urged forwardly against the outer edge 112 of the resilient finger 110 by the torsion spring 95 as shown in FIG. 17. The projection 114 also serves as a stop which the tab 99 abuts to limit the rearward movement of the metering release 71. When the button 74 is released, the spring 104 urges the metering release 71 forwardly to its normal position, also as shown in FIG. 17.

In the dispensing position of the release stop 84 shown in FIG. 17, the metering gear 80 and therefore the drive pinion 23 are free to rotate to dispense a length of paper towel. The drive pinion 23 rotates counterclockwise as the user pushes the handle 47 downwardly. The metering gear therefore rotates clockwise on the downward stroke of the lever actuator 45. Reverse rotation of the drive pinion 23 and of the metering gear 80 on the upward stroke of the handle 55 is prevented by the overrunning clutch 31. As the metering gear 80 is rotated clockwise, the forward wall of the release stop 84 rides onto the cam surface 108 and the release stop 84 follows the cam surface 108. In about the last quarter of rotation of the metering gear 80, the inside surface of the stop wall 88 engages the outside surface of the connected end 113 of the resilient finger 110 and begins to press the resilient finger 110 back into the plane of the metering gear 80. After one full revolution of the metering gear, the resilient finger 110 is pressed into the plane of the side of the metering gear and the abutment wall 109 of the cam portion 107 abuts the top of the stop wall 88 so that the metering gear 80 and the drive pinion 23 are stopped in their rotation. Thereby, the metering assembly is returned to the stopped position of FIGS. 8 and 15. If the user desires more paper towel, he must press the button 74 again to reset the metering assembly to the dispensing position before reciprocating the lever actuator 45.

The relative sizes of the drive roll 4, the drive pinion 23 and the metering gear 80 are such that one revolution of the metering gear 80 is sufficient to dispense a length of paper towel which is adequate for the normal user. While the projection 114 prevents the user from holding the release stop 84 backwardly and therefore prevents unmetered operation, the user can always dispense more paper towel by repeatedly depressing the button and dispensing. However, this procedure discourages wasteful use of paper towel.

Figure 20:
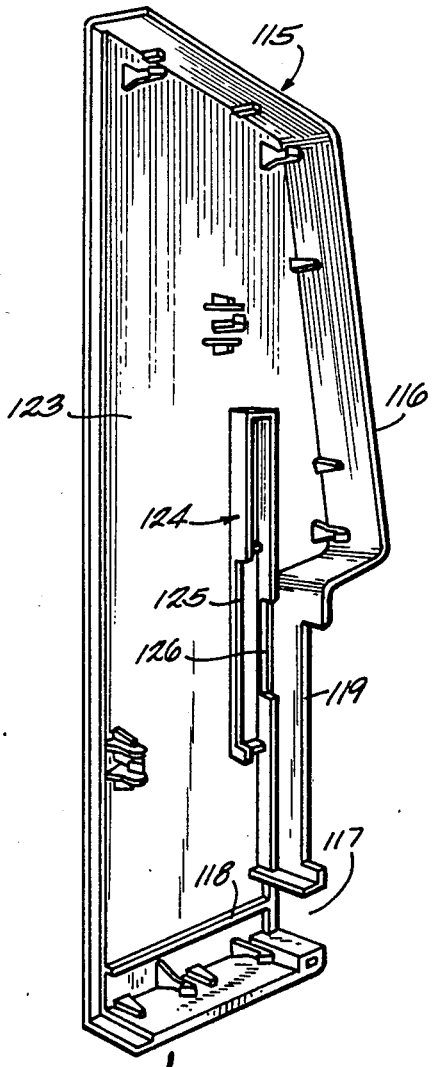
FIG. 20 is a perspective view of a cover for the mechanism module of FIG. 5 as viewed from the left rear side.
Figure 4:
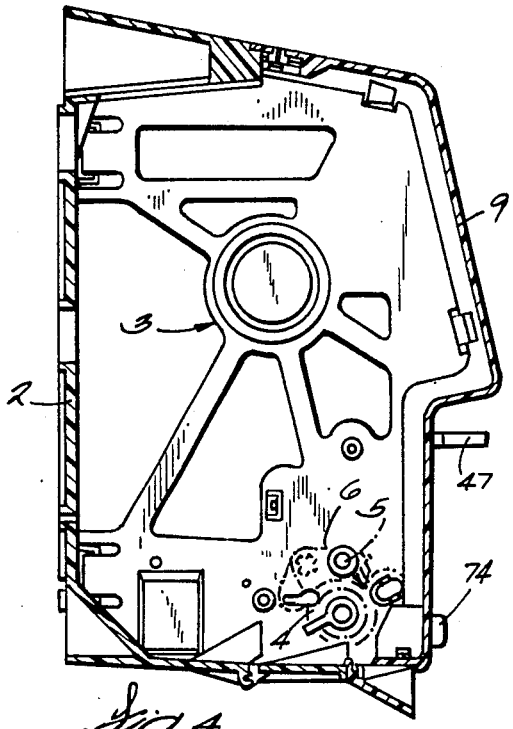
FIG. 4 is a sectional view taken along the plane of line 4—4 of FIG. 1.

A molded plastic cover 115 shown in FIG. 20 is secured to the mechanism plate 20 to hold the components of the operating mechanism in place. It can be secured to the mechanism plate by snap locking connectors which are fully described in the patent application entitled "Modular Paper Towel Dispenser," previously referred to, or by any other appropriate means.

The front wall 116 of the cover 115 is provided with a rectangular cut-out 117 which is aligned with the pushbutton 74 when the cover is assembled to the mechanism plate 20. The periphery of the cut-out 117 is reinforced and the button 74 protrudes from the front wall 116. A rib 118 is also provided which is aligned with the side edge of the metering release 71 to hold the front portion of the metering release in the channel 72. Note that it is also desirable to provide a similar rib in the back 2 as an extension of the rib 118 to hold the rear portion of the metering release 71 in the channel 72 when the mechanism module is assembled to the back.

To accomodate the lever actuator 45 and the handle 47, the front wall 116 of the cover 115 has an elongated cut-away 119 which is opposite from a similar cut-away 120 (FIG. 7) in the mechanism plate 20. These cut-aways are sized to receive a neck 121 (FIG. 14) of the handle 47. It is also noteworthy that the handle 47 is positioned below a lip 122 of the mechanism module to protect it against violent blows by the user.

A side wall 123 of the cover 115 abuts the gears of the operating mechanism when it is assembled to the mechanism plate 20 to hold the gears in place. A raised rib structure 124 is provided on the inside of the sidewall 123 to bear against the side of the lever actuator 45 to hold it in place as it is reciprocated. The rib structure 124 is cut-out as shown at 125 and 126 to allow clearance for the rack drive gear 68.

An operating mechanism providing a metered lever mode of operation for a paper towel dispenser cabinet has now been fully described. Although the invention is not intended to be limited by the preferred embodiment, it is considered that the preferred embodiment provides the metered lever mode of operation economically since essentially all of the components of the operating assembly are molded from plastic materials and are easy to assemble.

Numerous variations and modifications to the preferred embodiment will be apparent to those skilled in the art which will result in operating mechanisms which embody the invention. Therefore, it is not intended that the invention be limited by the preferred embodiment or the foregoing description thereof, but only by the claims which follow, except as otherwise required by law.

We claim:

1. A paper towel dispenser cabinet of the type adapted to store one or more rolls of paper towel to be dispensed, comprising:

(1) a delivery mechanism including a feed roll for engaging the paper towel from one of the rolls of paper towel and for delivering the paper towel to the exterior of the dispenser cabinet when the feed roll is rotated; and (2) an operating mechanism for operation by a user to rotate the feed roll, including:

(a) a drive pinion in driving engagement with the feed roll, (b) a lever actuator having a handle for operation by a user and which is connected for reciprocating movement in a vertical plane, and (c) means for rotatably driving the drive pinion with the lever actuator:

(3) metering means in engagement with the operating mechanism and operable by a user to release the lever actuator for limiting the number of successive reciprocations of the lever actuator between operations of the metering means by the user, wherein the metering means comprises:

(a) a metering gear in meshing engagement with the operating mechanism and including (i) a cam portion integral with and extending axially from a first side surface of the metering gear, the cam portion defining a radial cam surface which extends continuously around the axis of the metering gear in a first angular direction from a larger radius end to a smaller radius end and defining an abutment wall adjacent to the larger radius end of the cam surface, and (ii) a resilient finger integral with the metering gear and biased outwardly of the plane of the first side of the metering gear, the resilient finger including an outer edge substantially aligned with the larger radius end of the cam surface adjacent to the abutment wall;

(b) release means adjacent to the first side surface of the metering gear and movable relative to the metering gear between (i) a stopped position in which the release means presses the resilient finger toward the plane of the first side surface of the metering gear and abuts the abutment wall to stop rotation of the metering gear in a second angular direction opposite to the first direction, and (ii) a dispensing position in which the resilient finger is in its outwardly biased position and the release means is in engagement with the outer edge of the resilient finger to hold the release means in position to follow the cam surface;

(c) means operable by a user for moving the release means to its dispensing position; and (d) biasing means for urging the release means toward the axis of the metering gear to cause the release means to follow the cam surface to the stopped position of the release means as the metering gear is rotated in the second angular direction wherein the release means presses the resilient finger toward the plane of the first side surface of the metering gear as the release means follows the cam surface to the stopped position.

2. A paper towel dispenser cabinet as in claim 1, wherein the resilient finger comprises:

a free end adjacent to the abutment wall which is biased outwardly from the plane of the first side of the metering gear and includes the outer edge substantially aligned with the larger radius end of the cam surface; and a connected end integral with the metering gear in the plane of the first side surface of the metering gear positioned a distance in the second angular direction from the free end.

3. A paper towel dispenser cabinet as in claim 1, further comprising:

a cantilever spring catch integral with the release means to engage the means operable by a user in the stopped position of the release means; and means for releasing the cantilever spring catch from the means operable by a user as the release means is moved past its dispensing position.

4. A paper towel dispenser cabinet as in claim 1, wherein the release means includes a stop wall adjacent to the first side surface of the metering gear with a top surface which engages the abutment wall in the stopped position of the release means and a side surface which engages the outer edge of the resilient finger in the dispensing position of the release means.

5. A paper towel dispenser cabinet as in claim 1, wherein the means operable by a user comprises a metering release element including a button operable by a user and a body to which is slidably mounted the release means.

6. A paper towel dispenser cabinet as in claim 1, wherein the biasing means comprises a torsion spring in engagement with the release means to urge the release means toward the axis of the metering gear.

7. A paper towel dispenser cabinet as in claim 1, 2, 3, 4, 5 or 6, wherein the metering gear, the release means and the means operable by a user are made of plastic materials.

* * * * *